US010947100B2

(12) United States Patent
Corstanje et al.

(10) Patent No.: US 10,947,100 B2
(45) Date of Patent: Mar. 16, 2021

(54) KEG CLOSURE WITH ELEMENT FOR LOCKING THE VALVE IN AN OPEN POSITION

(71) Applicant: Petainer Large Container IP Limited, London (GB)

(72) Inventors: Erin Corstanje, Olney (GB); Benedetta Zancan, Newport Pagnell (GB)

(73) Assignee: Petainer Large Container IP Limited, London (GB)

( * ) Notice: Subject to any disclaimer, the term of this patent is extended or adjusted under 35 U.S.C. 154(b) by 0 days.

(21) Appl. No.: 16/483,280

(22) PCT Filed: Feb. 2, 2018

(86) PCT No.: PCT/GB2018/050305
§ 371 (c)(1),
(2) Date: Sep. 30, 2019

(87) PCT Pub. No.: WO2018/142150
PCT Pub. Date: Aug. 9, 2018

(65) Prior Publication Data

US 2020/0010312 A1 Jan. 9, 2020

(30) Foreign Application Priority Data

Feb. 3, 2017 (GB) ..... 1701851

(51) Int. Cl.
*B67D 1/08* (2006.01)
*B65D 47/24* (2006.01)
(Continued)

(52) U.S. Cl.
CPC ..... *B67D 1/0848* (2013.01); *B65D 47/24* (2013.01); *B67D 1/0832* (2013.01);
(Continued)

(58) Field of Classification Search
CPC .. B67D 1/0845; B67D 1/0829; B67D 1/0831; B67D 1/0848; B67D 1/0835;
(Continued)

(56) References Cited

U.S. PATENT DOCUMENTS 3,672,390 A * 6/1972 Gravesteijn ..... B67D 1/0832 137/212
3,776,260 A * 12/1973 Ruddick ..... B67D 1/0832 137/321
(Continued)

FOREIGN PATENT DOCUMENTS

CN 102574673 7/2012
CN 104768866 7/2015
(Continued)

OTHER PUBLICATIONS

Great Britain Application No. GB1701851.6 Combined Search and Examination Report dated May 22, 2017, 10 pages.
(Continued)

*Primary Examiner* — Patrick M. Buechner
(74) *Attorney, Agent, or Firm* — Kilpatrick Townsend & Stockton LLP

(57) ABSTRACT

A closure (1) for a beverage keg (90) is provided, comprising a valve housing (20) and a valve element (30), which is movable with respect to the valve housing (20) inwardly into an open state and outwardly into a closed state. A locking system comprises a locking element (50) that is movable with respect to the valve housing (20) and is capable of holding the valve element (30) in the open state. The locking element (50) comprises a body portion (51) located inside the valve housing (20) and a leg (56) that extends outwardly from the body portion (51) to the exterior of the valve housing (20). The leg (56) comprises an engagement element (57) that is configured to engage a stop formation fixed with respect to the valve housing (20) in order to limit the
(Continued)

maximum extent of movement of the locking element (50) in an upward direction relative to the valve housing (20) after beverage has been dispensed from the keg (90).

16 Claims, 12 Drawing Sheets

(51) Int. Cl.
*B67D 1/12* (2006.01)
*B65D 47/32* (2006.01)

(52) U.S. Cl.
CPC ..... *B67D 1/0847* (2013.01); *B65D 47/32* (2013.01); *B67D 1/125* (2013.01)

(58) Field of Classification Search
CPC ..... B67D 2001/0822; B65D 47/24; B65D 2547/00; B65D 2547/04; B65D 2555/02; B65D 45/16; B65D 45/18; B65D 47/00; B65D 47/02; B65D 47/04
USPC ..... 222/400.7
See application file for complete search history.

(56) References Cited

U.S. PATENT DOCUMENTS

| | | | | |
|---|---|---|---|---|
| 3,868,049 | A | 2/1975 | Johnston | |
| 4,142,658 | A * | 3/1979 | Golding | B67D 1/0832 137/212 |
| 4,363,336 | A * | 12/1982 | Cerrato | B67D 1/0832 137/212 |
| 4,411,287 | A * | 10/1983 | Hyde | B67D 1/0832 137/212 |
| 4,909,289 | A * | 3/1990 | Hagan | B67D 1/0832 137/312 |
| 5,526,965 | A * | 6/1996 | Degenkolbe | B67D 1/0838 222/400.7 |
| 5,645,192 | A * | 7/1997 | Amidzich | B65D 83/48 137/212 |
| 6,367,660 | B1 * | 4/2002 | Chang | B67D 1/0838 137/212 |
| 10,882,671 | B2 | 1/2021 | Paauwe et al. | |
| 2003/0006393 | A1 * | 1/2003 | Hullegien | B67D 1/0829 251/144 |
| 2011/0280502 | A1 | 11/2011 | Meike | |
| 2012/0248109 | A1 | 10/2012 | Fuchs et al. | |
| 2013/0334253 | A1 * | 12/2013 | Ahlstrom | B67D 1/0845 222/153.01 |
| 2015/0108175 | A1 * | 4/2015 | Wauters | B67D 1/125 222/400.7 |
| 2019/0352165 | A1 * | 11/2019 | Corstanje | B67D 1/0848 |

FOREIGN PATENT DOCUMENTS

| | | |
|---|---|---|
| CN | 106185774 | 12/2016 |
| GB | 2479467 | 10/2011 |
| WO | 2005113371 | 12/2005 |
| WO | 2005113414 | 12/2005 |
| WO | 2012062821 | 5/2012 |
| WO | 2012062874 | 5/2012 |
| WO | 2013176923 | 11/2013 |
| WO | 2016201421 | 12/2016 |

OTHER PUBLICATIONS

Great Britain Application No. GB1701851.6, Search Report for claims 25-37 dated Jul. 6, 2017, 3 pages.
Great Britain Application No. GB1701851.6, Search Report for claims 38-53 dated Jul. 6, 2017, 2 pages.
International Application No. PCT/GB2018/050305, International Search Report and Written Opinion dated Jun. 7, 2018, 13 pages.
CN Application No. 201880010231.7, Office Action dated Dec. 2, 2020, including English Translation, 22 pages.
CN Application No. 201880010232.1, Office Action dated Oct. 30, 2020, 17 pages.

* cited by examiner

KEG CLOSURE WITH ELEMENT FOR LOCKING THE VALVE IN AN OPEN POSITION

TECHNICAL FIELD

The present invention relates to a closure for a beverage keg that is configured for storing, transporting and dispensing beverage. Aspects of the invention relate to a closure for a beverage keg, and to a beverage keg supplied with or fitted with a closure.

BACKGROUND

Kegs are widely used in the distribution and dispensing of beverages such as beer. Kegs are typically provided with a closure that closes and seals a neck of the keg. The closure may define a pair of flow paths that enable beverage to be introduced into the keg during a filling operation, which is generally performed with the keg inverted. The flow paths may further enable beverage to be dispensed from the keg, for example with pressurised gas being introduced into the keg via a first one of the flow paths in order to force beverage out of the keg via the second flow path.

Traditional kegs are generally formed of metal, and are intended to be used many times before disposal. However, plastic kegs have also been introduced to the market, including disposable kegs that are stretch blow moulded from a preform of PET or another plastics material.

It is generally desirable to ensure that a keg is depressurised after use, for example after the contents of the keg have been dispensed. This is particularly the case for disposable plastic kegs, which are generally crushed after use. For this purpose some dispense heads include a purge valve that is operable to vent propellant gas from the keg before the closure is disconnected from the dispense head. Some closures also include a mechanism for preventing a valve element of the closure from returning to a closed state after disconnection from a dispense head in order to ensure that no residual pressure remains within the keg. However, such mechanisms are often complicated and expensive, and may include long tolerance chains and be prone to failure.

In addition, it is desirable to limit the internal pressure experienced within a keg. For this purpose some closures include an automatic venting system. However, known venting systems are generally complicated and expensive, especially when applied to plastics closures that may in some cases be disposable items intended for disposal together with a keg after use, and may not provide reliable venting at a consistent internal pressure.

Finally, it is generally desirable to minimise the cost and complexity of keg closures, to increase the ease of assembly, and to provide a rugged design. However, known closures often include a significant number of parts forming the main structure of the closure, and can be difficult and time-consuming to assemble.

It is an aim of the present invention to address disadvantages associated with the prior art.

SUMMARY OF THE INVENTION

According to a first aspect of the present invention there is provided a closure for a beverage keg, the closure comprising:

a valve housing;

a valve element that is movable with respect to the valve housing inwardly into an open state and outwardly into a closed state; and a locking system comprising a locking element that is movable with respect to the valve housing and is capable of holding the valve element in the open state;

wherein the locking element comprises a body portion located inside the valve housing and a leg that extends outwardly from the body portion to the exterior of the valve housing, wherein the leg comprises an engagement element that is configured to engage a stop formation fixed with respect to the valve housing in order to limit the maximum extent of movement of the locking element in an upward direction relative to the valve housing (and an outward direction with respect to the keg) after beverage has been dispensed from the keg.

The locking system enables the valve element to be retained in an open state, for example after the closure has been decoupled from a dispense head after beverage has been dispensed from a keg, any may therefore prevent re-filling and re-pressurisation of the keg after the original contents of the keg have been dispensed.

By providing the locking element with engagement elements that are configured to limit the maximum extent of movement of the locking element on legs that extend to the exterior of the valve housing, the present invention provides a locking system that is space efficient and minimises the impact of the locking system on the height of the valve housing and the closure. The claimed arrangement of the locking element also results in a reduced tolerance chain, and results in a locking system that is simple, rugged and reliable.

The locking element may comprise a plurality of the legs, for example four legs spaced apart around the body portion of the locking element. In this case each of the legs may extend outwardly from the body portion to the exterior of the valve housing and comprise an engagement element that is configured to engage a stop formation fixed with respect to the valve housing. The engagement elements may each be configured to engage separate respective stop formations, or alternatively may each be configured to engage a single common stop formation. Any features of the leg, the engagement element and the stop formation described below may equally apply to each leg, each engagement element and each stop formation where multiple legs, engagement elements and stop formations are present.

The valve housing may comprise a base including an aperture, wherein the leg extends to the exterior of the valve housing through the aperture provided in the base. The base may define a bottom end of the valve housing. The base may extend between an outer housing wall and an inner duct of the closure. The base may be formed by a wall including one or more apertures, or by a plurality of struts defining apertures between adjacent struts. Alternatively the leg may extend to the exterior of the valve housing through an aperture provided in a side wall of the valve housing.

The stop formation may be external to the valve housing.

The stop formation may be provided on the valve housing.

The stop formation may be provided at the base of the valve housing.

The stop formation may optionally protrude outwardly from the closure component on which it is provided. Alternatively the engagement element may simply engage a surface of a closure component, such as the underside of the base or an underside of the outer housing wall, in which case the surface of the closure component that is configured to be engaged by the engagement element may be regarded as a stop formation.

The stop formation may comprise an engagement surface that is angled with respect to the longitudinal axis of the closure in order to increase the security of engagement between the stop formation and the engagement element.

The body portion of the locking element may be at least substantially annular. The body portion of the locking element may surround a spring that is configured to bias the valve element towards its closed state.

The leg may extend outwardly from the body portion of the locking element in a generally downward direction (and an inward direction with respect to the keg). The leg may generally be angled inwardly with respect to the closure in a direction away from the body portion and/or may comprise an inwardly stepped portion in a direction away from the body portion.

The leg may be generally elongate. The leg may taper inwardly towards its distal tip.

The engagement element may be located at or near to a distal tip of the leg furthest from the body portion of the locking element.

The engagement element may comprise a hook formation with a hooked upper surface.

The engagement element may protrude from the leg in a radially inward direction with respect to the closure.

The locking element may be movable relative to the valve housing between a first position in which the valve element is engageable with the locking element at a first coupling when the valve element is moved into an open state (for example for filling), and a second position in which the valve element is engageable with the locking element at a second coupling when the valve element is moved into an open state (for example for dispensing). The second position may be axially above the first position, and outboard of the first position with respect to the keg.

The locking element may be configured to be moved from the first position into the second position by moving together with the valve element when the valve element moves from an open state into a closed state while engaged with the locking element at the first coupling, with said movement of the locking element into the second position enabling engagement of the valve element at the second coupling on subsequent movement of the valve element into an open state.

The locking element may comprise one or more catch formations. The first coupling may be provided by engagement of one or more of the catch formations with a first latch element provided on the locking element, and the second coupling may be provided by engagement of one or more of the catch formations with a second latch element provided on the locking element axially below the first latch element. The second latch element may be located in the body portion of the locking element, and the first latch element may be provided on an arm that extends upwardly from the body portion of the locking element.

The locking element may be movable relative to the valve housing from the second position into a third position axially above the second position in which the engagement element of the locking element engages the stop formation to prevent further upward movement of the locking element (and the valve element) relative to the valve housing. Alternatively the engagement element of the locking element may engage the stop formation when the locking element is in the second position.

The locking system may comprise a retaining arrangement for releasably retaining the locking element in the first position and/or for preventing downward movement of the locking element from the second position back into the first position after the locking element has been moved into the second position. The retaining arrangement may comprise a clip formation provided on the locking element that is engageable with one or more corresponding features provided in the valve housing, for example one or more apertures provided in an outer wall of the housing.

The closure may further comprise a head portion configured for attachment to a filling head or dispense head. The head portion may be configured for attachment to flat type filling heads and dispense heads, for example Type-A or Type-G filling heads and dispense heads, or alternatively for attachment to Type-S or Type-D filling heads and dispense heads.

According to a further aspect of the present invention there is provided a beverage keg supplied with or fitted with a closure including any of the features described above.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible.

BRIEF DESCRIPTION OF THE DRAWINGS

One or more embodiments of the invention will now be described, by way of example only, with reference to the accompanying drawings, in which.

DETAILED DESCRIPTION

Figure 1:
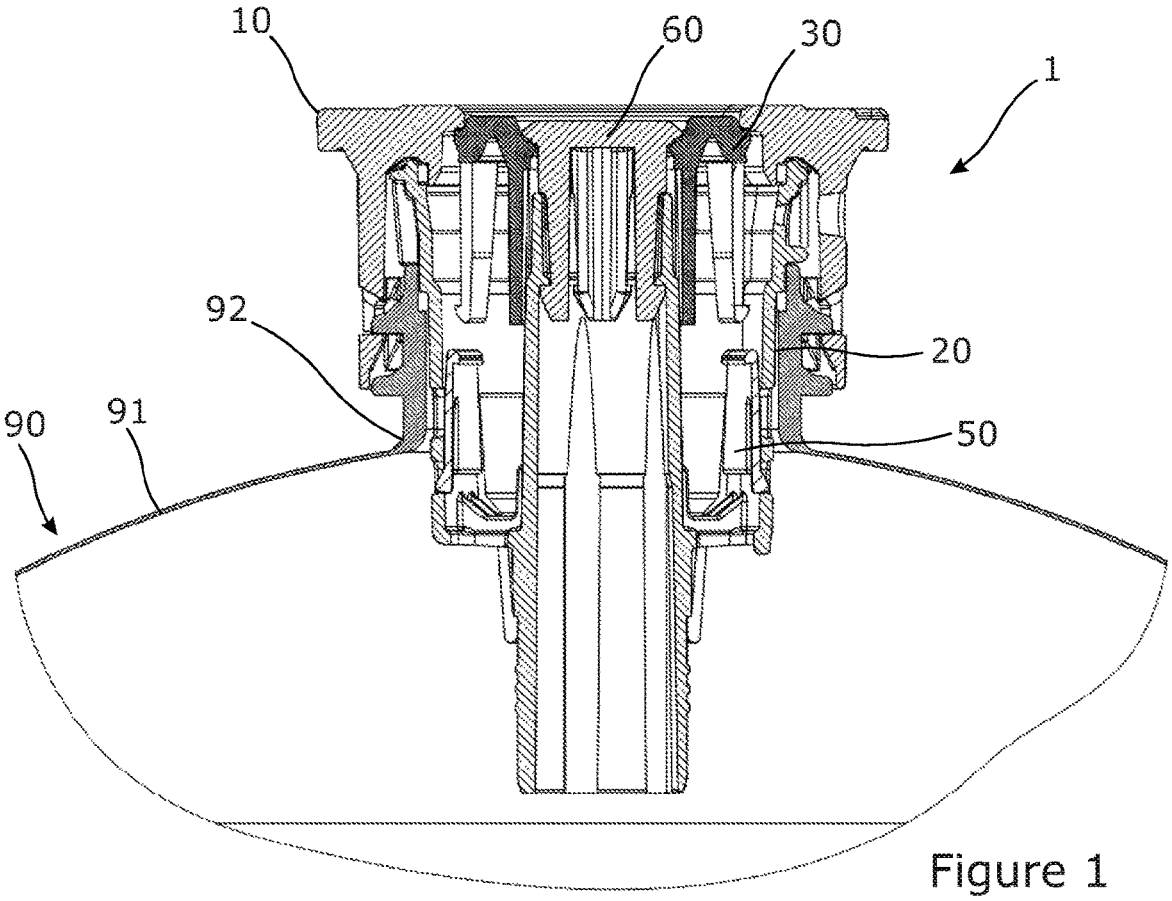
FIG. 1 is a view that illustrates a cross-section view through a keg assembly comprising a plastics keg and a closure according to an embodiment of the present invention.
Figure 2:
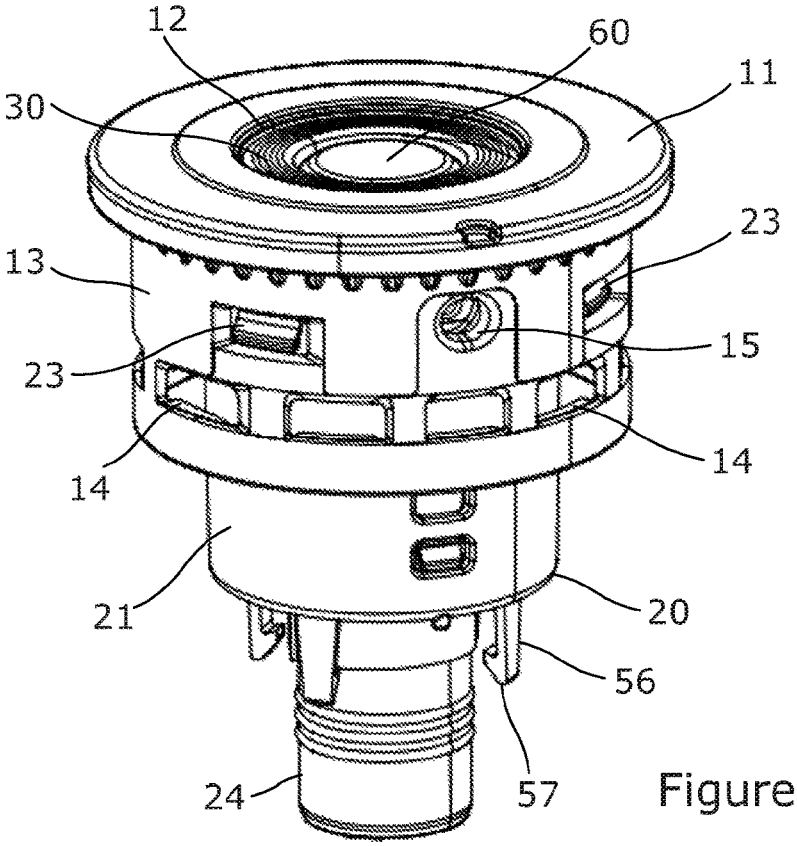
FIG. 2 is a view that illustrates the closure in isolation.
Figure 3:
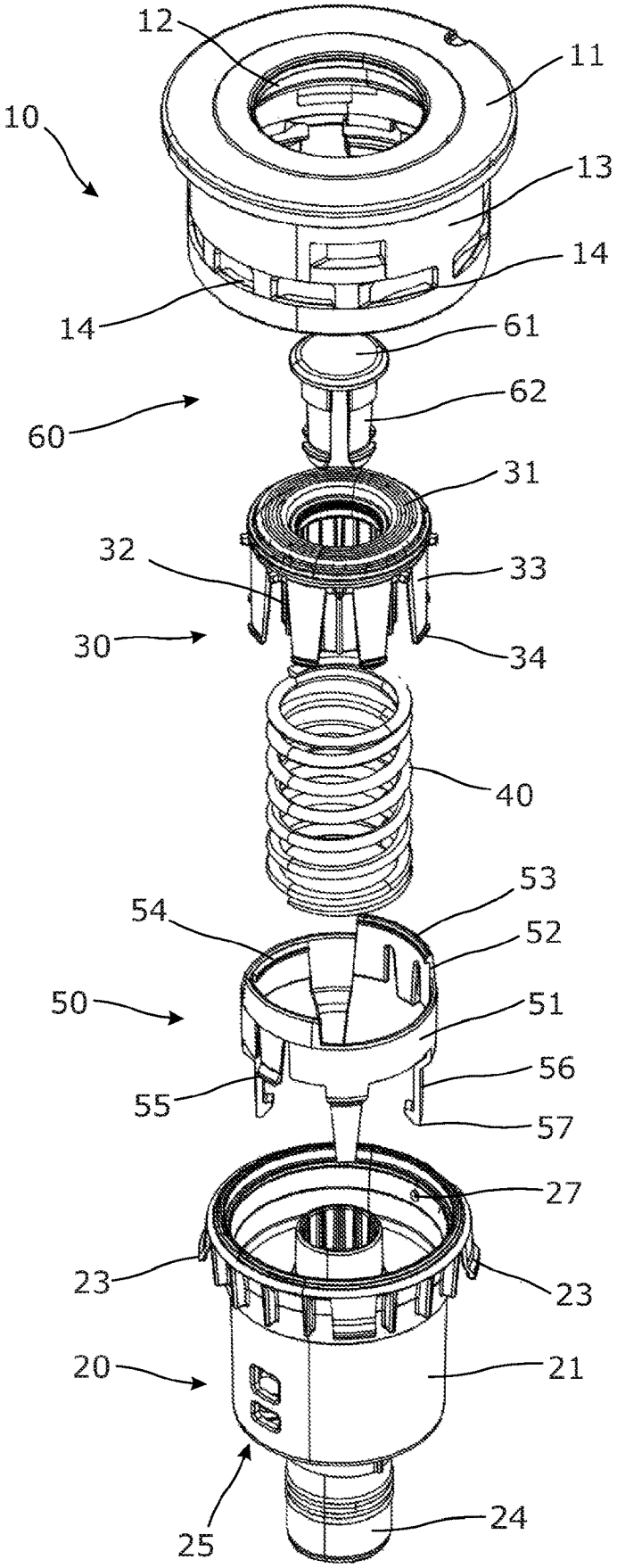
FIG. 3 illustrates an exploded view of the components of the closure.

FIG. 1 illustrates a cross-section view through a keg assembly comprising a plastic keg 90 and a closure 1 according to an embodiment of the present invention. The closure 1 is also illustrated in isolation from the keg 90 in FIG. 2, and an exploded view of the components of the closure 1 is illustrated in FIG. 3.

The keg 90 comprises a substantially hemispherical base portion including a plurality of blister like feet arranged in a petaloid formation on which the keg 90 may stand in use. The keg 90 further comprises a cylindrical body portion that is integrally formed with and extends upwardly from the top of the base portion, and a substantially hemispherical shoulder portion 91 that is integrally formed with the body portion at the top edge thereof. At the top of the shoulder portion 91 the keg 90 is provided with a neck portion 92 that defines an opening of the keg 90. The closure 1 is connected to the neck 92 of the keg 90 via a snap fit engagement, as described in more detail below.

The keg 90 is stretch blow moulded from a preform of plastic, such as a PET preform, and is configured to be used in the distribution and pressurised dispensing of a beverage such as draught beer (although in other embodiments the keg 90 may equally be configured for use with other carbonated or non-carbonated beverages). The keg 90 is designed to be self-standing on the feet of its base portion in use (for example during pressurized dispensing using conventional draught beer dispensing apparatus), and is designed to be able to independently withstand the internal pressures associated with the pressurised dispensing of draught beer (for example at a pressure of 1 to 4 bar). The keg 90 may include a barrier layer in order to increase the shelf life of beer contained therein.

The structure and operation of the closure 1 will now be described. It will be appreciated that all references to directions made in relation to the closure 1 and components of the closure 1 throughout this specification, such as "upwardly", "downwardly", "top", "bottom" and "underside", are made with respect to a closure in an upright orientation as illustrated in FIG. 1, this being the orientation in which the closure 1 is arranged when connected to a keg 90 that is standing in an upright orientation on its base. It will further be appreciated that the orientations of each part of the closure 1 may vary in use, for example if the closure is used in an orientation different to that illustrated in FIG. 1.

The closure 1 comprises an attachment part 10 or outer head part or snap ring for attaching the closure 1 to the neck 92 of the keg 90. The attachment part 10 comprises an annular head portion 11 that is arranged at the top of the neck 92 of the keg 90 when the closure has been fitted to the keg 90. The head portion 11 has a substantially planar top surface and includes a flange portion that overhangs the neck 92 of the keg 90, and is configured to cooperate with filling heads and dispense heads. The closure 1 is a Type-A closure, and the head portion 11 is configured to cooperate with standard Type-A filling heads and dispense heads used in the distribution and pressurised dispensing of draught beer in a conventional manner. The head portion 11 comprises a central aperture 12 that is configured to be opened and closed by a movable valve element 30 in order to selectively open and close concentric inner and outer flow paths through the closure 1, as described in more detail below.

The attachment part 10 further comprises an annular attachment portion or outer wall 13 that extends downwardly from the underside of the head portion 11. The annular wall 13 is configured to receive at least an upper portion of the neck 92 of the keg 90 therein when the closure 1 has been fitted to the keg 90. The annular wall 13 is provided with a plurality of clip formations 14 that extend radially inwardly from the annular wall 13 towards its lower end. The clip formations 14 are configured to snap over an annular ring provided around the neck 92 of the keg 90 in order to enable the closure 1 to be snap fitted onto and securely retained on the neck 92 of the keg 90.

The closure 1 further comprises an integrated housing component 20 that is mounted to the attachment part 10. The integrated housing component 20 is illustrated in isolation in FIG. 4*a*, in cross-section in FIG. 4*b*, and from underneath in FIG. 4*c*.

The integrated housing component 20 comprises an annular wall or outer housing wall 21. The outer housing wall 21 and the head portion 11 of the attachment part 10 together define a valve housing within which the valve element 30 and a spring 40 configured to bias the valve element 30 towards a closed position are housed. The main body of the housing is defined by the outer housing wall 21, and the top part of the housing is defined by the head portion 11 of the attachment part 10.

The top edge of the outer housing wall 21 is received within a circumferential groove provided on the underside of the head portion 11 of the attachment part 10. The integrated housing component 20 is mounted to the attachment part 10 by a plurality of clip formations 23 that are connected to the outer housing wall 21 adjacent to its top edge and are received within a corresponding plurality of apertures provided in the annular wall 13 of the attachment part 10 when the integrated housing component 20 has been push fitted together with the attachment part 10.

The outer housing wall 21 is received with a close fit within the neck portion 92 of the keg 90 when the closure 1 has been fitted to the keg 90. An O-ring may optionally be provided between the outer housing wall 21 and the inner surface of the neck 92 of the keg 90 in order to improve sealing performance. The outer housing wall 21 comprises an upper portion that extends above the top of the neck 92 of the keg when the closure 1 has been fitted to the keg 90.

The integrated housing component 20 further comprises an inner duct part 24 or spear connector in the form of an elongate tube. The inner duct 24 is arranged concentrically within the outer housing wall 21 and extends through the housing defined by the outer housing wall 21. The inner duct 24 divides the housing into an annular outer space (between the outer housing wall 21 and the inner duct 24) defining an outer flow path through the closure 1, and an inner space (inside the inner duct 24) defining an inner flow path through the closure 1.

The inner duct 24 extends to a height slightly below the top edge of the outer housing wall 21, and is provided with a centre cover 60 at its upper end. The centre cover 60 comprises an end cap 61 that sits above the open upper end of the inner duct 24. The centre cover 60 further comprises a plurality of legs 62 that extend downwardly from the end cap 61, each comprising an outwardly protruding clip formation. The legs 62 are received within the upper end of the inner duct 24 with the clip formations provided on the legs 62 engaged with a downwardly facing shoulder formed near to top of the inner duct 24 in order to securely retain the centre cover 60 with respect to the inner duct 24 and resist outward movement of the centre cover 60. The end cap 61 of the centre cover 60 is spaced slightly apart from the top end of the inner duct 24 such that the centre cover 60 does not seal the top end of the inner duct 24, but rather allows fluid communication between the interior of the inner duct 24 and the region immediately surrounding the top end of the inner duct 24 in between the legs 62 of the centre cover 60.

The annular valve element 30 comprises an annular head portion 31 and a skirt 32 that extends downwardly from the head portion 31, both of which surround the inner duct 24 and engage the outer surface of the inner duct 24. The valve element 30 further comprises a plurality of arms 33 that extend downwardly from the head portion 31 outboard of the skirt 32. The arms 33 are spaced apart from each other such that flow passages are provided between the arms 33. Each arm 33 is provided with a radially outwardly extending engagement structure 34 or catch formation at its lower end. The engagement structures 34 or catch formations each include a ramped lower surface and an upper surface defining a hook. The purpose of the arms 33 and engagement structures 34 or catch formations is described in detail below.

The valve element 30 is configured for sliding movement along the inner duct 24 within the valve housing. The valve element 30 has an upper closed position (illustrated in FIG. 1) in which the head portion 31 of the valve element 30 engages and forms a seal with each of the head portion 11 of the attachment part 10 (around its outer edge) and the end cap 61 of the centre cover 60 (around its inner edge), thereby closing the outer and inner flow paths through the closure 1. The valve element 30 is movable into an open position by depressing the valve element 30 with respect to the valve housing. When the valve element 30 has been moved into an open position, fluid communication between the outer flow path and the exterior of the closure 1 is permitted between the valve element 30 and the head portion 11 of the attachment part 10, and fluid communication between the inner flow path and the exterior of the closure 1 is permitted between the valve element 30 and the end cap 61 of the centre cover 60.

In the present embodiment, the inner duct 24 is connected to the outer housing wall 21 forming the main body of the valve housing by a connecting portion 25 such that the inner duct 24 and the outer housing wall 21 are integrally formed together as part of a single integrated housing component 20. The connecting portion 25 extends radially inwardly from the bottom edge of the outer housing wall 21, and defines a closed base of the valve housing. The spring 40 (which is located within the valve housing in the annular space between the outer housing wall 21 and the inner duct 24) is arranged in compression between the connecting portion 25 (forming the base of the valve housing) and the valve element 30 such that the valve element 30 is biased upwardly towards its closed position.

The connecting portion 25 may take the form of a wall, optionally a substantially planar horizontal wall including a plurality of apertures 26 or cut-outs, or a plurality of separate struts spaced circumferentially apart from each other to define apertures 26 or cut-outs therebetween. The apertures 26 provided in the connecting portion 25 allow fluid communication between the outer flow path of the closure 1 and the headspace within the keg 90, for example to allow beverage to be introduced into a keg 90 through the closure 1 during filling operations and to allow beverage to be passed through the closure 1 to the exterior of a keg 90 during dispensing operations.

Figure 7:
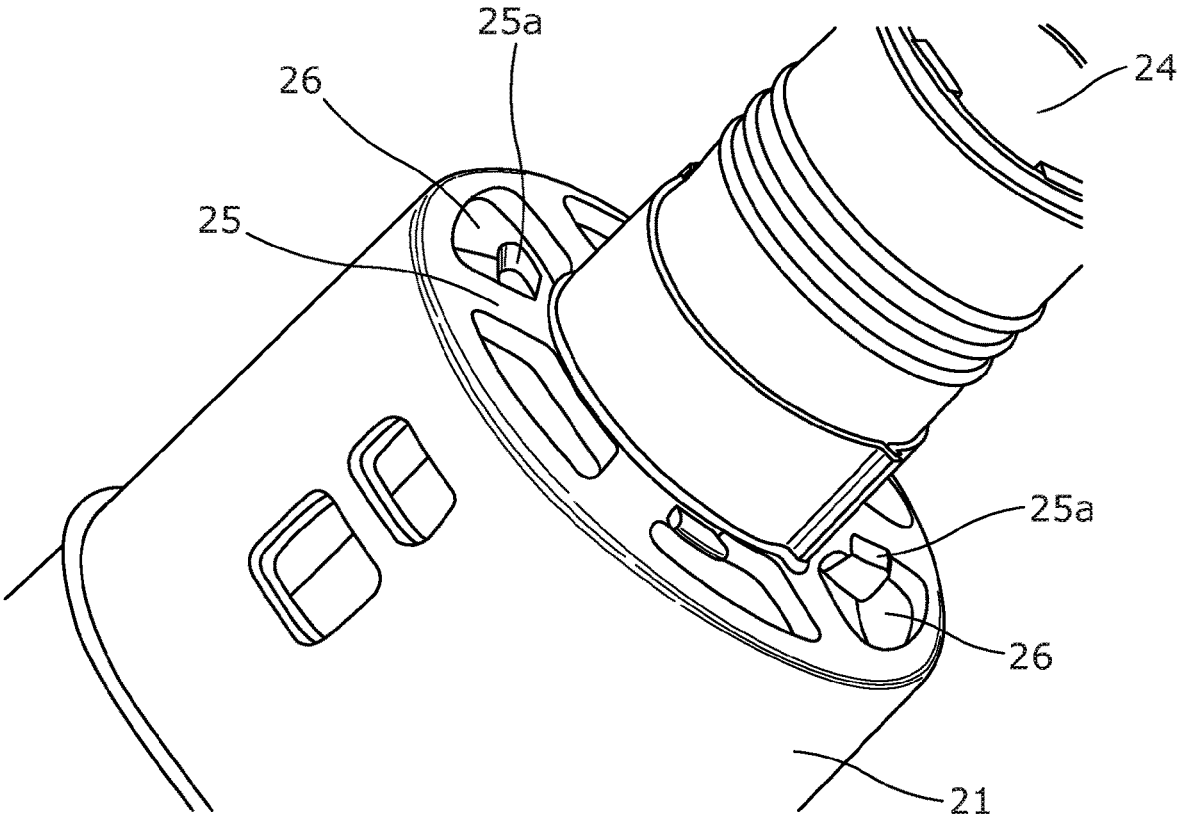
FIG. 7 is a view of the underside of the housing component illustrated in FIGS. 4*a* to 4*d*.

The apertures 26 are also configured to receive legs of a locking element located within the valve housing, as described in detail below. Four of the apertures are provided with a stop formation 25*a* that projects into its respective aperture. The stop formations 25*a* are illustrated in FIG. 7. Each stop formation 25*a* includes an engagement surface that sits proud of the underside of the base 25 and is configured to be engaged by an engagement element or hook formation of the locking element, as described in detail below. The engagement surfaces of the stop formations 25*a* are angled with respect to the longitudinal axis of the closure 1 in order to increase the security of engagement with the engagement elements or hook formations.

The inner duct 24 extends downwardly below the connecting portion 25 to provide a tail portion that may be press fitted into an elongate tube or spear (not illustrated). The tube preferably extends to a position at or close to the bottom of the keg 90 in order to provide fluid communication between the bottom of the keg 90 and the interior of the inner duct 24, thereby allowing beverage contained within the keg 90 to be drawn from the bottom of the keg 90 up into the interior of the inner duct 24 and through the closure 1 via the inner flow path.

The attachment part 10, integrated housing component 20 and valve element 30 are each preferably injection moulded plastics components. The above-described closure 1 may be assembled by first inserting the spring 40 and valve element 30 into the annular space defined between the outer housing wall 21 and the inner duct 24 of the integrated housing component 20. The centre cover 60 may then be press fitted into the inner duct 24 and the integrated housing component 20 may be press fitted together with the attachment part 10 in order to complete the closure 1. The elongate tube may optionally be supplied together with the closure 1, and may be fitted to the closure before the closure 90 is fitted to the neck 92 of a keg 90.

The above-described closure construction results in a closure 1 that is simple, rugged and reliable. The closure 1 is also easy to assemble with a low parts count.

Figure 4A:
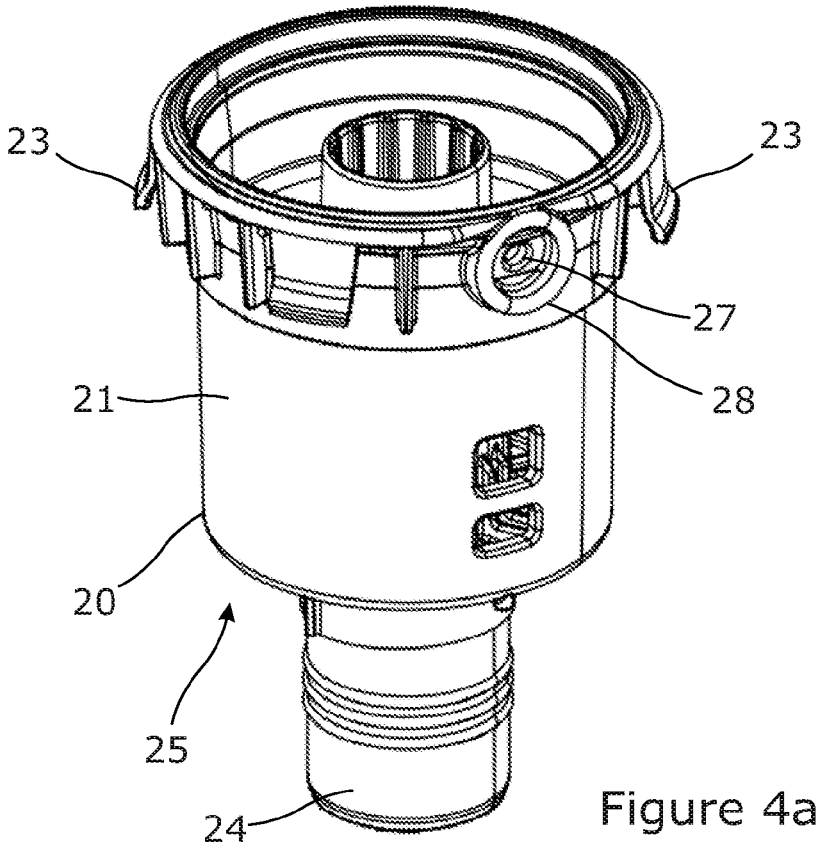
FIGS. 4*a* to 4*h* illustrate various views of a housing component of the closure.
Figure 4B:
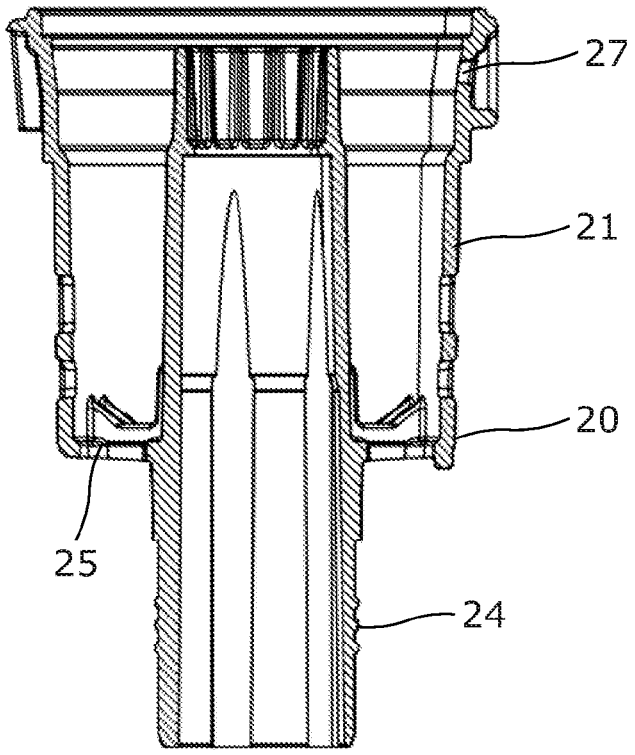

In accordance with the present invention, the closure 1 is provided with a venting system for automatically limiting internal pressure within a keg 90 to which the closure 1 is fitted. The venting system comprises a vent aperture 27 formed through a portion of the valve housing. In the present embodiment the vent aperture 27 takes the form of a circular hole with a diameter of approximately 2.4 mm that extends through the outer housing wall 21 of the integrated housing component 20, as illustrated in FIGS. 1, 4*a* and 4*b*. The vent aperture 27 is provided in the upper portion of the outer housing wall 21 at a location close to the top edge of the outer housing wall 21, and therefore is located outside the neck 92 of the keg 90 when the closure 1 has been fitted to the keg 90. The vent aperture 27 is surrounded by a small annular wall 28 with an outside diameter of approximately 10 mm and an inside diameter of approximately 7 mm that extends a small distance outwardly from the radially outer surface of the outer housing wall 21. Alternatively, the annular wall 28 may extend from the radially inner surface of the outer housing wall 21.

Figure 4C:
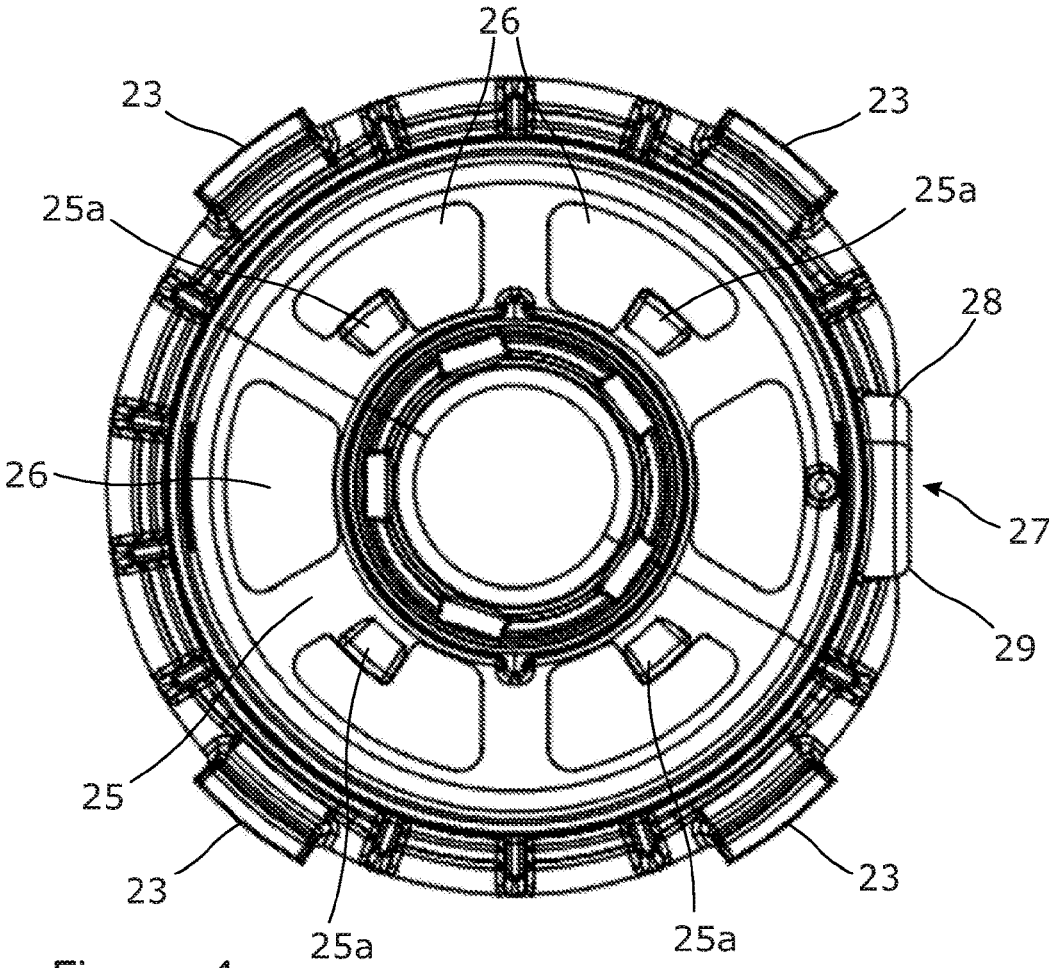

The vent aperture 27 is provided with a barrier 29 that is attached to the outer housing wall 21 around the vent aperture 27 and closes and seals the vent aperture 27 when the closure 1 is in an unvented configuration (as supplied to customers for use). The barrier 29 is not shown in FIGS. 4*a* and 4*b*, but is illustrated in the view of FIG. 4*c* and in the schematic partial cross-section view of FIG. 4*d* taken horizontally through the outer housing wall 21 at the location of the vent aperture 27. The thickness of the barrier 29 has been exaggerated in FIGS. 4*c* and 4*d* for improved clarity.

The barrier 29 comprises a membrane or layer of film with a total thickness of approximately 0.03 mm. In the present embodiment the barrier 29 takes the form of a laminated film comprising an aluminium foil layer 29*a* with a thickness of approximately 0.02 mm and a cover or backing layer 29*b* formed of a plastics material such as LDPE. The aluminium foil layer 29*a* is the main structural component of the barrier 29 and provides structural strength to the barrier 29. The cover or backing layer 29*b* faces towards the interior of the closure 1 and acts as an inert barrier between the aluminium foil layer 29*a* and the interior of the closure 1. The cover or backing layer 29*b* may additionally assist with welding or adhesion of the barrier 29 to the closure 1. The film may be similar to the aluminium films used in blister packs for medicines. The barrier 29 takes the form of a disk with a diameter of approximately 10 mm and has a circular outer shape, although other shapes are also possible.

Figure 4D:
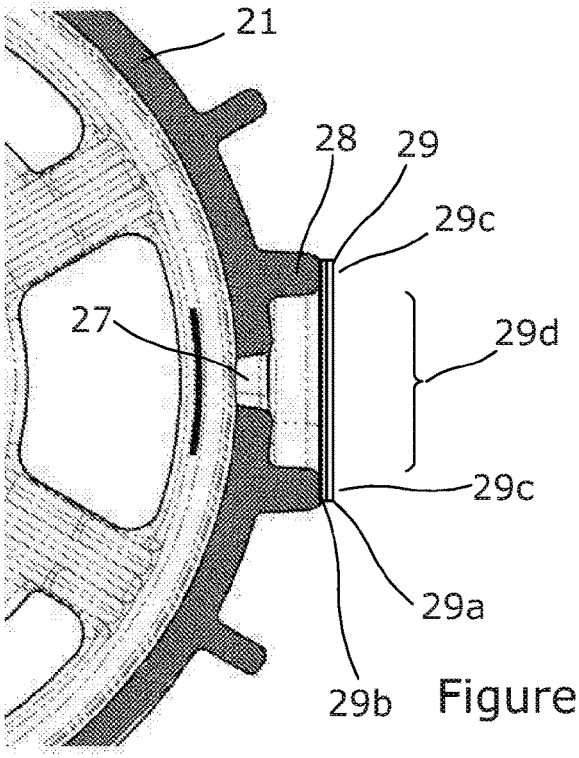

In the present embodiment the barrier 29 is positioned on top of the annular wall 28. The barrier 29 is welded to the outer housing wall 21, for example by sonic welding, induction or heat welding, such that the annular wall 28 melts and forms a weld between an outer portion 29*c* or attachment portion of the barrier 29 and the outer housing wall 21, the weld extending around the vent aperture 27, as schematically illustrated in FIG. 4*d*. Alternatively, the annular wall and the barrier may be applied to the inner housing wall 21. The barrier 29 includes a free or unattached inner portion 29*d* (inboard of the weld). In the present embodiment the outside diameter of the weld is approximately 10 mm and the diameter of the free or unattached inner portion 29*d* is approximately 7 mm. In this way the barrier 29 is attached to the valve housing without any requirement for additional retaining components, which reduces the cost, complexity and parts count of the closure 1. In other embodiments the annular wall 28 could be omitted and the barrier 29 could instead be welded directly onto the curved outer surface of the outer housing wall 21, or alternatively the barrier 29 could be bonded to the outer housing wall 21 by an adhesive. In a further alternative, an annular recess at the inner or outer surface of the housing wall 21 may form the contact surface for welding the barrier to. In such an embodiment, the welded barrier will be radially positioned in line with the housing wall 21.

The annular wall 13 of the attachment part 10 of the closure 1 extends downwardly from the head portion 11 to a level below the vent aperture 27 and the barrier 29. The annular wall 13 of the attachment part 10 therefore provides protection to the barrier 29 when the closure 1 has been fully assembled. However, the annular wall 13 of the attachment part 10 is provided with an inspection/access aperture 15 extending therethrough which is aligned with the vent aperture 27 provided in the outer housing wall 21. The inspection/access aperture 15 provided in the annular wall 13 of the attachment part 10 allows visual inspection of the barrier 29. The inspection/access aperture 15 also allows access to the barrier 29 to enable targeted manual depressurisation of the keg 90 to which the closure 1 is attached, as described in more detail below.

In the present embodiment the annular wall 13 of the attachment part 10 is provided with a single inspection/access aperture 15 that should be aligned with the vent aperture 27 and the barrier 29 when the attachment part 10 is attached to the outer housing wall 21 of the integrated housing component 20. In order to ensure correct alignment of the attachment part 10 relative to the outer housing wall 21 during assembly of the closure 1, the attachment part 10 and the outer housing wall 21 are each provided with a recognisable feature to assist with alignment. In the present embodiment the recognisable features take the form of a small recess provided in the top surface of the head portion 11 of the attachment part 10 and a small protrusion provided at the bottom of the outer housing wall 21 (both visible in FIG. 2) which should be aligned with each other before attachment of the attachment part 10 to the outer housing wall 21.

In other embodiments the attachment part 10 may be configured to be attached to the outer housing wall 21 of the integrated housing component 20 in multiple different orientations in order to increase the ease of assembly of the closure 1. For example, the attachment part 10 may be configured to be attached to the integrated housing component 20 in any one of four possible orientations spaced 90 degrees apart from each other about the central longitudinal axis of the closure 1 (with any one of the clip formations 23 of the integrated housing component 20 engaged within any one of the corresponding apertures provided in the annular wall 13 of the attachment part 10). In this case the annular wall 13 of the attachment part 10 may include a plurality of the inspection/access apertures 15 circumferentially spaced apart from each other around the annular wall 13, with each one of the inspection/access apertures 15 being configured to be aligned with the vent aperture 27 and the barrier 29 in one possible assembled orientation of the attachment part 10 relative to the integrated housing component 20. In this way it is possible to ensure visibility of and access to the barrier 29 irrespective of the orientation of the attachment part 10 relative to the integrated housing component 20.

The barrier 29 is configured to rupture if the internal pressure within the closure 1 (and within a keg 90 to which the closure 1 is fitted) exceeds a predetermined maximum allowable pressure. The predetermined maximum allowable pressure is preferably between the maximum working pressure of the keg 90 (that is the highest pressure expected to be experienced during use of the keg 90) and the failure pressure of the keg 90 (that is the pressure at which the keg 90 is predicted to fail). In the present embodiment the predetermined maximum allowable pressure is approximately 6 bar (gauge pressure, as used throughout the specification), and is between a maximum working pressure of approximately 5.5 bar and a keg failure pressure of approximately 7 bar. In this way the vent aperture 27 and barrier 29 allow the interior of a keg 90 to which the closure 1 is fitted to be automatically and completely vented if the internal pressure within the keg 90 exceeds a predetermined maximum pressure permitted by the closure 1.

The vent aperture 27 and the barrier 29 are positioned such that automatic venting of a keg 90 is permitted while the closure 1 is coupled to a filling head or a dispense head, as well as after the closure 1 has been separated from a filling head (for example after the completion of a filling operation) or a dispense head (for example after the contents of the keg 90 has been dispensed).

The barrier 29 is not resealable, and so the depressurisation caused by the barrier 29 rupturing is permanent, and it is not subsequently possible for the keg 90 to be repressurised and used with the closure 1 still attached to the keg 90.

It has been found that the above-described venting system allows reliable automatic venting of the closure 1 (and a keg 90 to which the closure 1 is attached) at a predetermined maximum allowable pressure with an acceptably small burst pressure variation between closures of the same design. The above-described venting system is also simple and cost-effective due to the low cost of the barrier 29 and the lack of additional components required to secure the barrier 29 to the valve housing.

In the present embodiment the barrier 29 typically ruptures from a region adjacent to the side of the vent aperture 27 and/or adjacent to the outer portion of the barrier 29 (which is welded to the outer housing wall 21). However, in other embodiments the barrier 29 may be configured to rupture from its centre, and/or to rupture at a pre-weakened area which may be provided at any suitable location on the barrier 29, and/or to become at least partially detached from the outer housing wall 21 (with at least a portion of the weld or bond between the barrier 29 and the outer housing wall 21 failing).

The maximum pressure permitted by the closure 1 (that is the internal pressure at which automatic venting occurs) is governed by, among other factors: a) the strength of the barrier 29; b) the strength of the weld or bond between the barrier 29 and the outer housing wall 21, c) the diameter of the free or unattached inner portion 29*d* of the barrier 29 (inboard of the weld or bond) and d) the diameter of the vent aperture 27. The strength of the barrier 29 is affected by, for example, the materials selected for the barrier, the thickness of the barrier 29 or individual layers of the barrier 29, and the presence or absence of any pre-weakened areas. The maximum pressure permitted by the closure 1 may therefore be varied by controlling the strength of the barrier 29, the strength of the weld or bond, the diameter of the free or unattached inner portion 29*d* of the barrier 29 and/or the diameter of the vent aperture 27. It is therefore possible to use the same main structural valve components (for example the same attachment part 10 and integrated housing component 20) to form different closures 1 that provide different maximum permitted pressures for different applications or different customers, for example by selecting a different barrier 29, by varying the strength of the weld or bond, by varying the diameter of the free or unattached inner portion 29*d* of the barrier 29 and/or by providing vent apertures 27 of different sizes.

Since the barrier 29 is visible through the inspection/access aperture 15 provided in the annular wall 13 of the attachment part 10, it is possible to determine or confirm whether or not the barrier 29 has ruptured by inspection of the barrier 29 through the inspection/access aperture 15.

It is also possible to perform manual targeted depressurisation of a keg 90 to which the closure 1 is attached by manually rupturing the barrier 29. For example, a pin or other tool may be manually inserted through the inspection/access aperture 15 and used to rupture the barrier 29 to move the barrier into an unsealed state and thereby depressurise the keg 90.

Figure 4E:
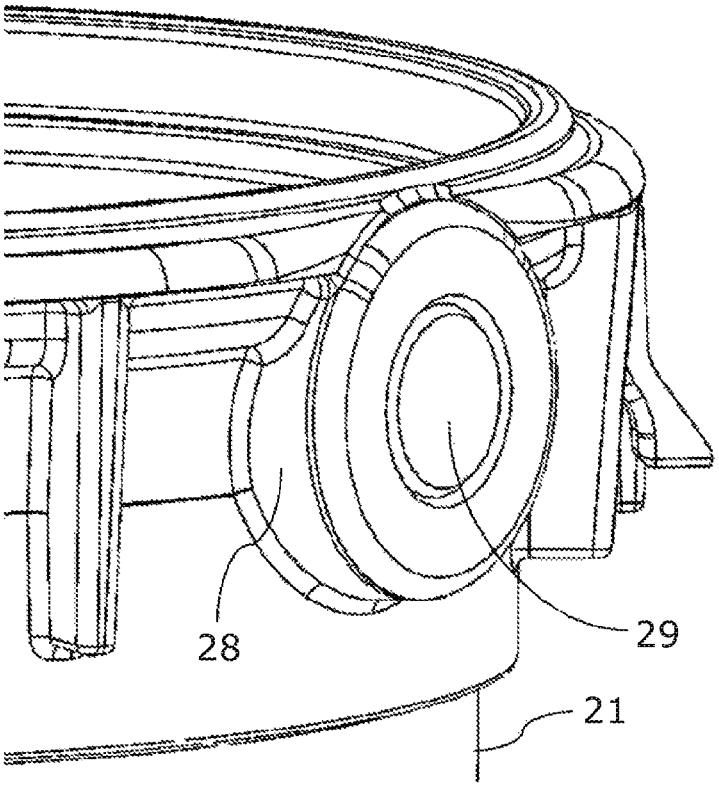
Figure 4F:
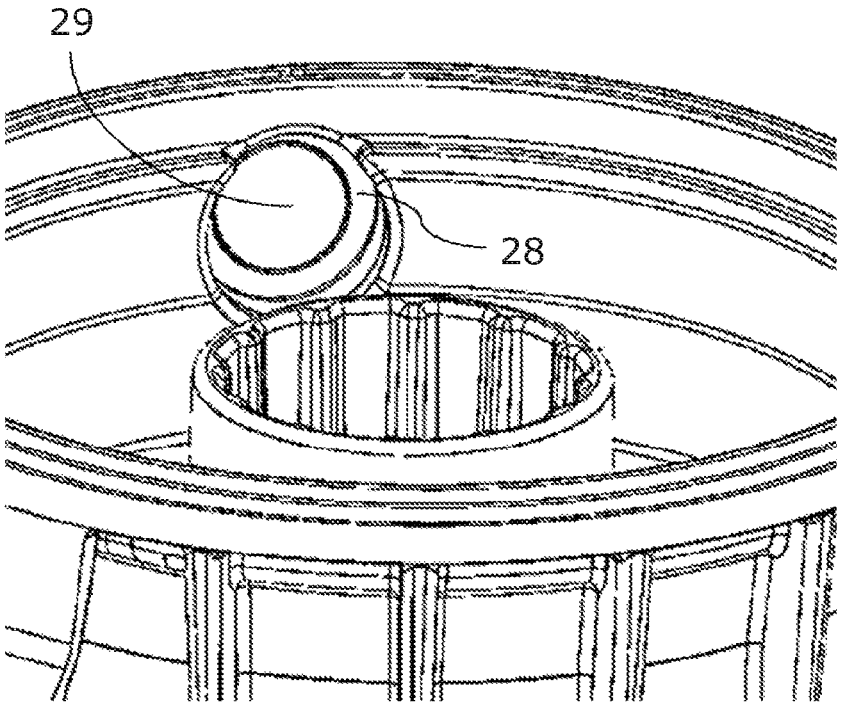

FIGS. 4*e* and 4*f* show a close-up of a perspective view on a further embodiment of the barrier 29, functioning as a pressure relieve valve in a closure wall. Where FIG. 4*e* shows the barrier 29 as seen from the outside of the valve housing 20, FIG. 4*f* shows it as seen from its inside. As an alternative to welding the barrier 29 onto the housing wall 21, the barrier 29 in these figures is provided by injection moulding the barrier 29 as an integral part of the housing 21. During the injection moulding process, a shifting component may compress the area where the barrier 29 is formed to obtain a very well performing barrier 29. The compressed area will get a smaller thickness than the surrounding parts of the injection moulded object, such that it is weak enough to burst at a desired pressure limit, but still strong enough to reliably seal the venting aperture 27 under normal operation conditions. The preferred thickness of the barrier 29 depends on the material use for the housing, the specific geometric design of the barrier 29 and its connection to the rest of the valve housing 21 and the target pressure at which the barrier should burst. For example, the barrier 29 may have a thickness in the range of about 0.1 mm to about 2 mm. Some additional advantages of using an integral barrier instead of a welded one are that only one material is needed for both the valve housing 21 and the barrier and a costly welding step can be omitted. Examples for suitable materials for the valve housing 21 and the integrated barrier 29 are PET and PP, but other types of plastics may also be used.

The valve housings 21 shown in FIGS. 4*e* and 4*f* do not have a separate venting aperture in addition to the barrier 29. After having burst, the barrier 29 provides for the aperture through which the pressure can be released. In an alternative embodiment, an additional venting aperture with a well-defined shape and size may be provided adjacent the barrier 29. This may be done before and/or after the barrier 29, i.e. closer to the inner or outer surface of the valve housing 21.

Figure 4G:
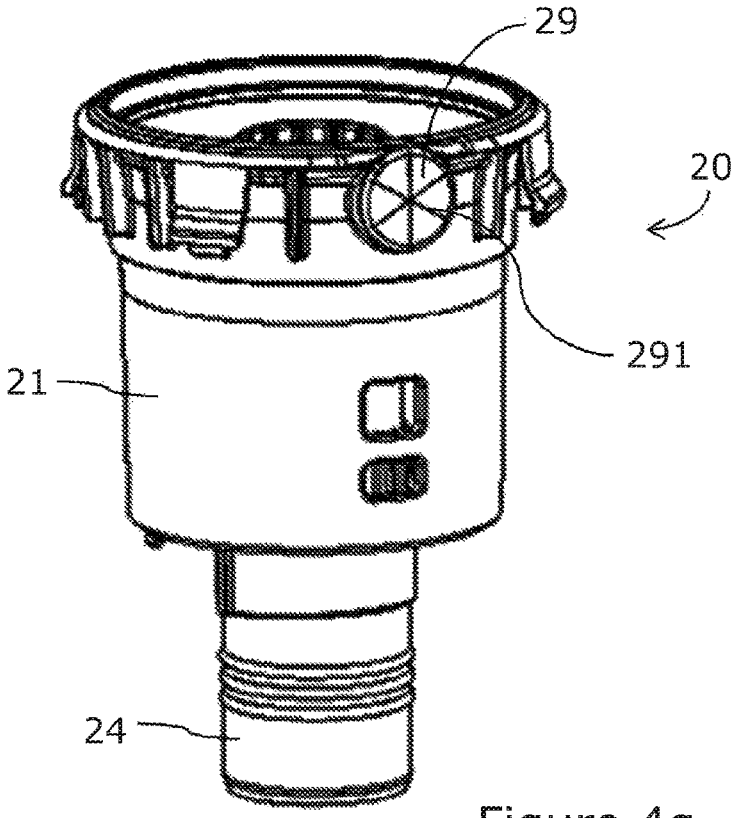
Figure 4H:
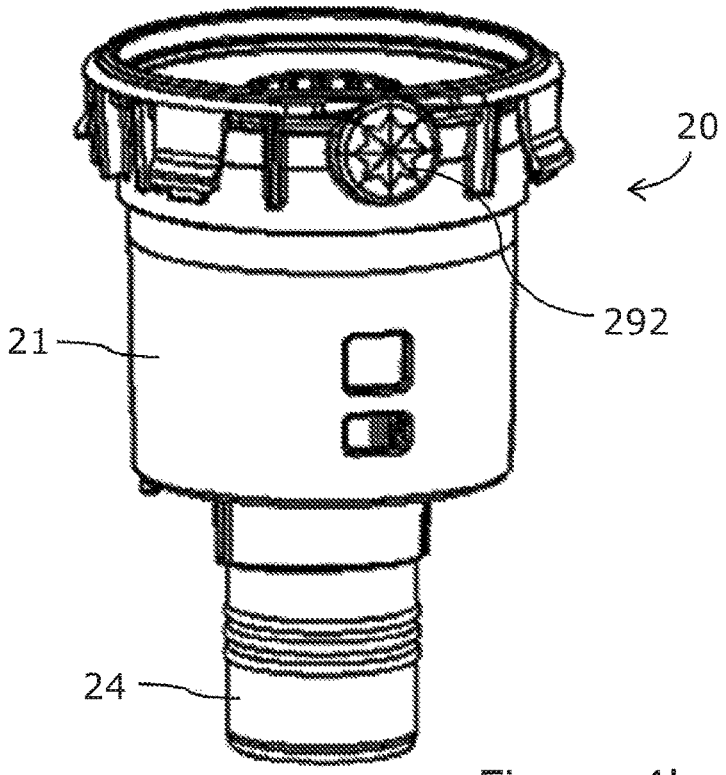

The barrier surface area may be substantially flat and plain as shown in FIGS. 4*e* and 4*f*, but may alternatively comprise burst marks 291, 292 as shown in FIGS. 4*g* and 4*h*.

A first exemplary burst mark 291 in FIG. 4*g* is implemented in the form of three narrow lines crossing each other in the barrier centre and splitting the circular barrier 29 into six substantially equal pie sections. In FIG. 4*h*, the burst marks 292 splits the barrier 29 into 8 substantially equal pie sections with an additional indentation in each. The burst marks 291, 292 are narrow indentations of the barrier surface that locally provide an even smaller thickness than at the other parts of the barrier 29. Alternatively, small squares, circles, or other geometrical shapes may be used for the burst marks. Because of this even smaller thickness, an increasing pressure will cause the barrier 29 to break at the indentations first. A barrier 29 provided with burst marks 291, 292 may or may not have a slightly thicker overall barrier thickness. E.g., the overall barrier thickness is in the range of about 0.1 mm to about 2 mm and the wall thickness at the burst mark is in the range of about 0.05 mm to about 0.5 mm.

In the here shown exemplary embodiments, the burst marks 291, 292 are provided at the barrier outer surface. Alternatively or additionally, burst marks may be provided at the barrier inner surface too. Burst marks 291, 292 at the inner and outer barrier surface may be identical, have different designs or have the same designs, but rotated over an angle between 0° and 360°. The design and exact thickness of the indentations influences the pressure at which the barrier 29 will burst and the shape of the valve opening that appears after the bursting. Possible advantages of the use of burst marks 291, 292 instead of a plain barrier 29 are better control of the exact pressure at which the barrier 29 will burst and better control over the way in which it bursts.

It is to be noted that the burst marks 291, 292 are here described as features of an integrally moulded barrier 29, but that such burst marks can be used, with similar effect, in welded or otherwise adhered barriers 29 of various different materials too.

In accordance with the present invention, the closure 1 comprises a locking system for locking the valve element 30 in an open position after the closure has been coupled to a dispense head. The locking system comprises a locking element 50 with a generally annular shape that is received within the valve housing between the outer housing wall 21 and the head portion 11 of the attachment part 10. The locking element 50 is arranged around the inner duct 24 and the spring 40, and is configured for axial movement within the valve housing.

The locking element 50 comprises an annular main body portion 51 that extends continuously around the inner duct 24 and the spring 40. The locking element 50 further comprises a pair of arms 52 that extend upwardly from the main body portion 51. The arms 52 are spaced apart from each other on opposite sides of the main body portion 51 and are separate from each other by cutouts or apertures.

The locking element 50 comprises a pair of upper engagement structures 53 and a pair of lower engagement structures 54 each extending radially inwardly with respect to the closure 1. The upper engagement structures 53 are integrally formed with and provided towards the upper ends of the arms 52. The lower engagement structures 54 are integrally formed with and provided towards the top of the main body portion 51. The lower engagement structures 54 are located in-between the arms 51 and at a height below the upper engagement structures 53. Each of the upper and lower engagement structures 53, 54 takes the form of an inwardly extending latch element comprising a ramped upper surface and a radially inwardly projecting underside defining a hook.

The locking element 50 further comprises a pair of resilient arms located in its main body portion 51, each including a clip formation 55. The clip formations 55 each extend radially beyond the annular main body portion 51 and include a ramped upper surface. The clip formations 55 are aligned with the upwardly extending arms 52 and the upper engagement structures 53, and in-between the lower engagement structures 54.

The locking element 50 further comprises a set of four legs 56 that extend downwardly from the main body portion 51. Each of the legs 56 tapers inwardly towards its distal lower end, and includes an inwardly stepped portion at an intermediate position along its length. Each of the legs 56 is provided with a radially inwardly projecting engagement element or hook formation 57 at its distal lower end. The legs 56 extend though the apertures 26 provided in the base 25 of the valve housing to the exterior of the valve housing.

Operation of the locking system during use of the closure 1 will now be described with reference to FIGS. 5*a* to 5*e* and 6*a* to 6*e*. FIGS. 5*a* to 5*e* illustrate cross-sections through the closure 1 taken in line with the upper latch elements 53 of the locking element 50, while FIGS. 6*a* to 6*e* illustrate cross-sections through the closure 1 taken in line with the lower latch elements 54 of the locking element 50.

Figure 5A:
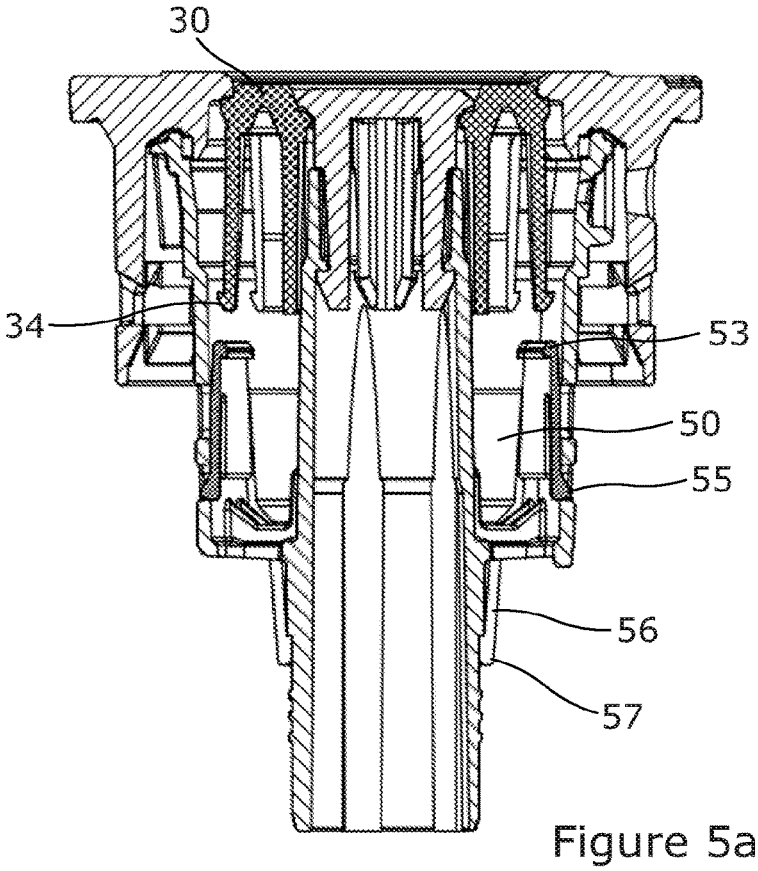
FIGS. 5*a* to 5*e* and 6*a* to 6*e* illustrate cross-section views through the closure at various stages of its operation.
Figure 6A:
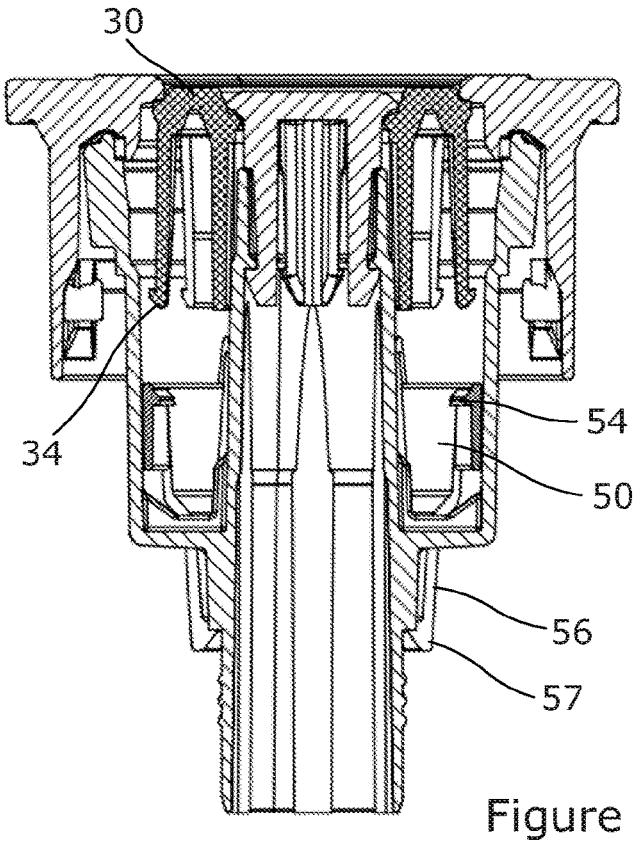

FIGS. 5*a* and 6*a* illustrate the closure 1 in its initial configuration as supplied to customers (before connection to any filling head or dispense head). When the closure 1 is in its initial configuration the locking element 50 is in a first position or lower position near with the main body portion 51 close to the base of the valve housing. When the locking element 50 is in this first position the outwardly facing clip formations 55 are engaged respectively with a pair of lower apertures provided in the outer housing wall 21 to thereby retain the locking element 50 in the first position.

Figure 5B:
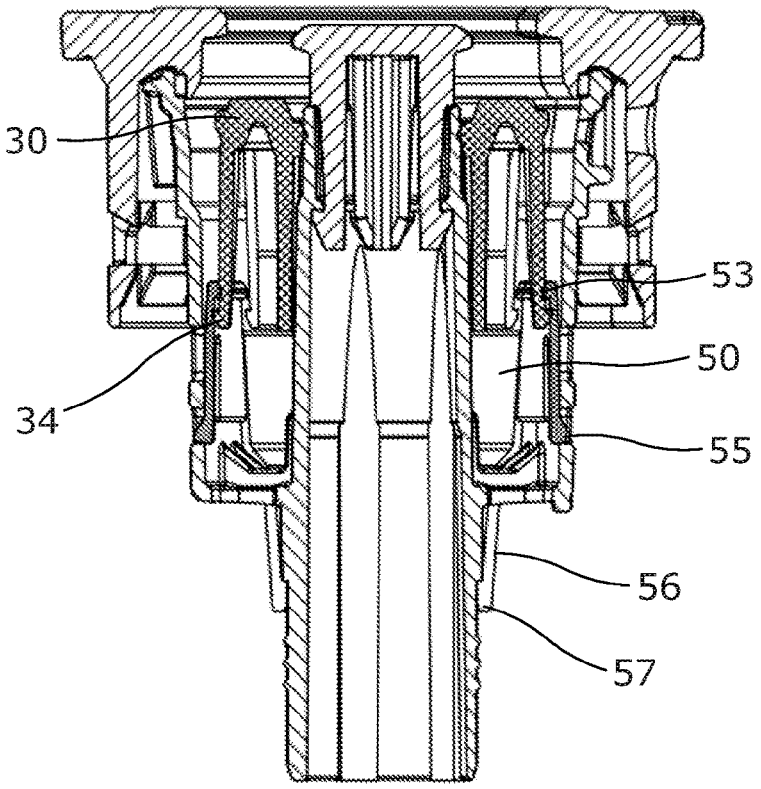
Figure 6B:
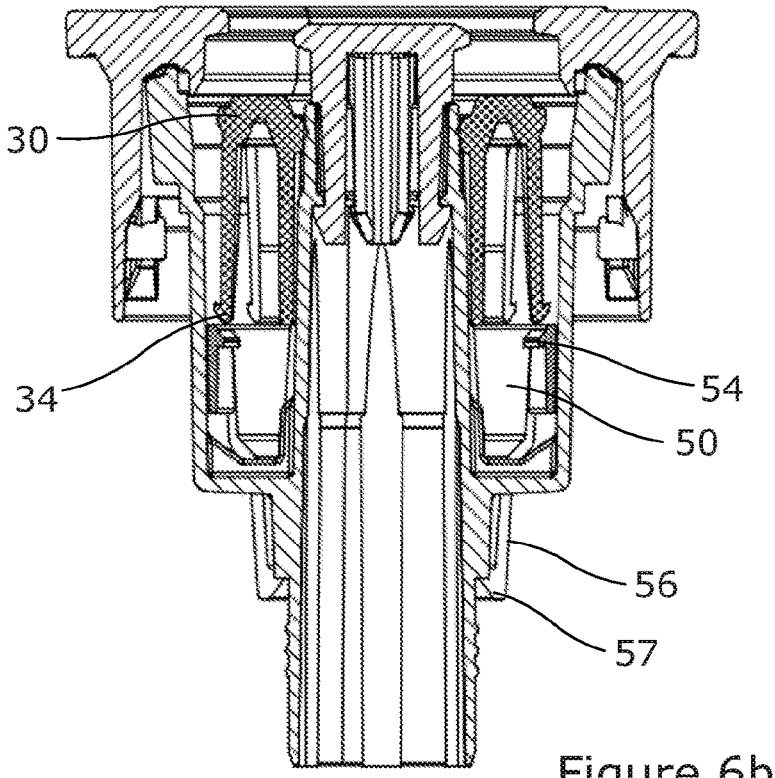

When it is desired to fill a keg 90 to which the closure 1 is fitted with beverage, the closure 1 may be connected to a standard Type-A filling head including an annular plunger that presses down on the valve element 30 to move the valve element from its upper closed position downwardly (and inwardly with respect to the keg 90) into an open position in which fluid communication is established with each of the outer and inner flow paths through the closure 1, as illustrated in FIGS. 5*b* and 6*b*. The keg 90 can then be filled with beverage through the closure 1, for example via the outer flow path.

When the valve element 30 is moved downwardly into its open position for filling, as illustrated in FIGS. 5*b* and 6*b*, the catch formations 34 provided on the arms 33 of the valve element 30 move past the upper latch elements 53 provided on the upwardly extending arms 52 of the locking element 50 to a position axially below the upper latch elements 53. The catch formations 34 that are aligned with the upper latch elements 53 are deflected inwardly as their ramped lower surfaces pass over the ramped upper surfaces of the upper latch elements 53.

Figure 5C:
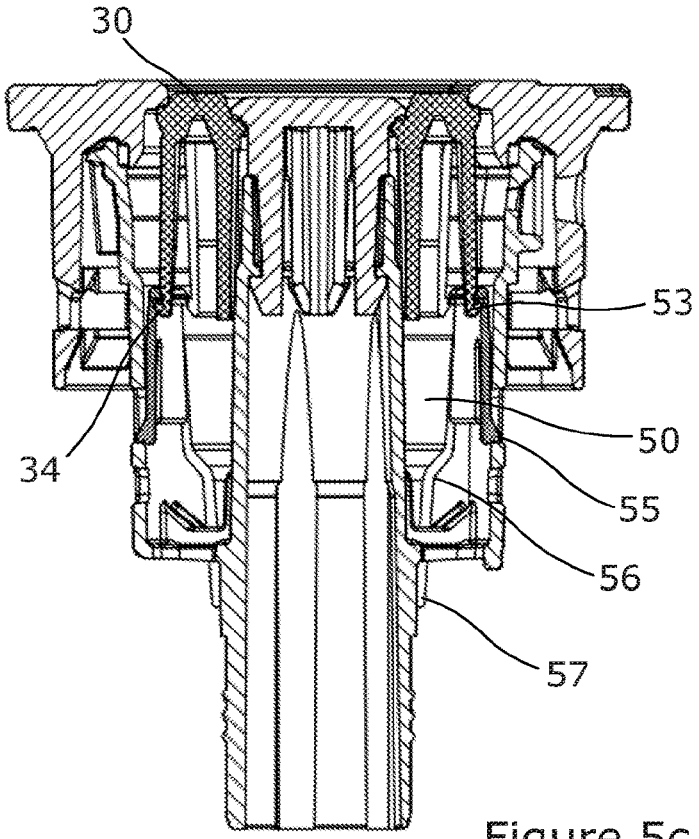
Figure 6C:
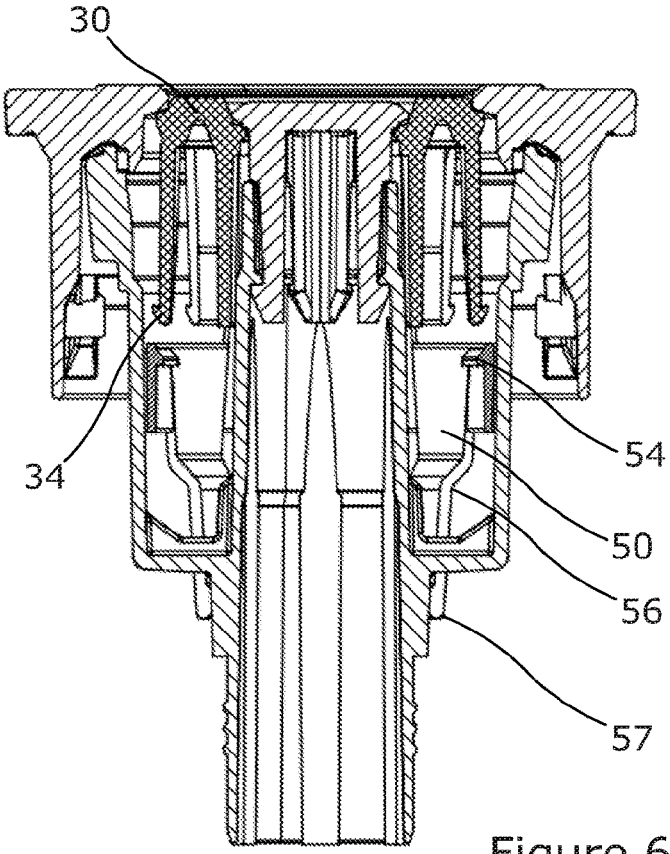

When the closure 1 is decoupled from the filling head, the valve element 30 moves upwardly (and outwardly with respect to the keg 90) back into its closed position under the action of the spring 40, as illustrated in FIGS. 5*c* and 6*c*. Once the valve element 30 has returned to its closed position the closure 1 is sealed such that the filled keg 90 can be stored and transported. Once the keg 90 has been filled the closure 1 may optionally be provided with means for dust protection and tamper evidence, such as a foil or polypropylene cap (not shown), which may be secured to the keg or closure using a tear-band.

As the valve element 30 moves upwardly back towards its closed position after filling, the hooked upper surfaces of the catch formations 34 that are aligned with the upper latch elements 53 engage the hooked undersides of the upper latch elements 53 such that the locking element 50 moves upwardly (and outwardly with respect to the keg 90) together with the valve element 30 into a second position or raised position as shown in FIGS. 5*c* and 6*c*. Engagement between the catch formations 34 and the upper latch elements 53 constitutes a first coupling between the valve element 30 and the locking element 50.

The outwardly facing clip formations 55 of the locking element are able to move inwardly on their respective resilient arms in order to enable the clip formations to ride out of the lower apertures provided in the outer housing wall 21 as the locking element 50 moves towards its raised position. Once the locking element 50 has reached its raised position, the clip formations 55 become engaged respectively with a pair of upper apertures provided in the outer housing wall 21 above the lower apertures.

Engagement of the clip formations 55 with the upper apertures acts to prevent subsequent downward movement of the locking element 50 with respect to the valve housing.

Figure 5D:
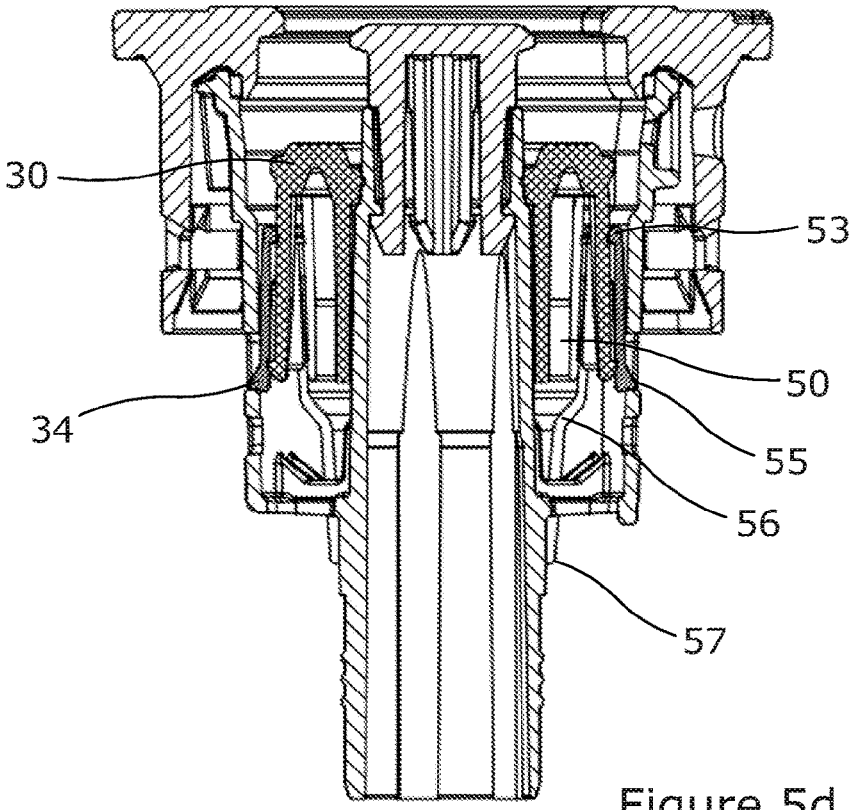
Figure 6D:
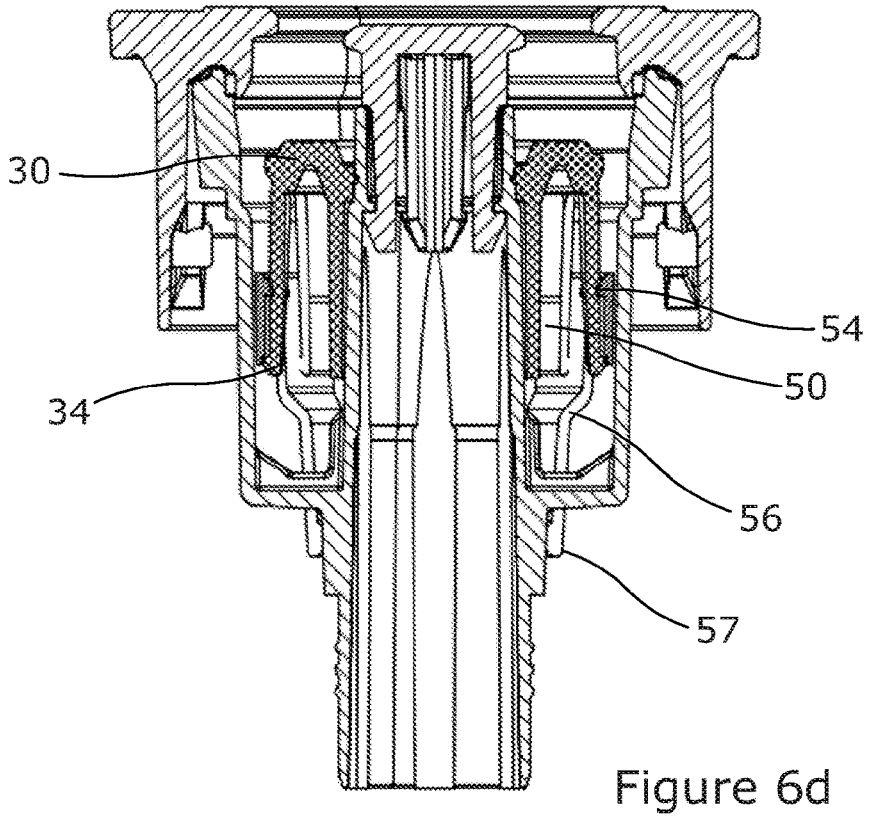
Figure 5E:
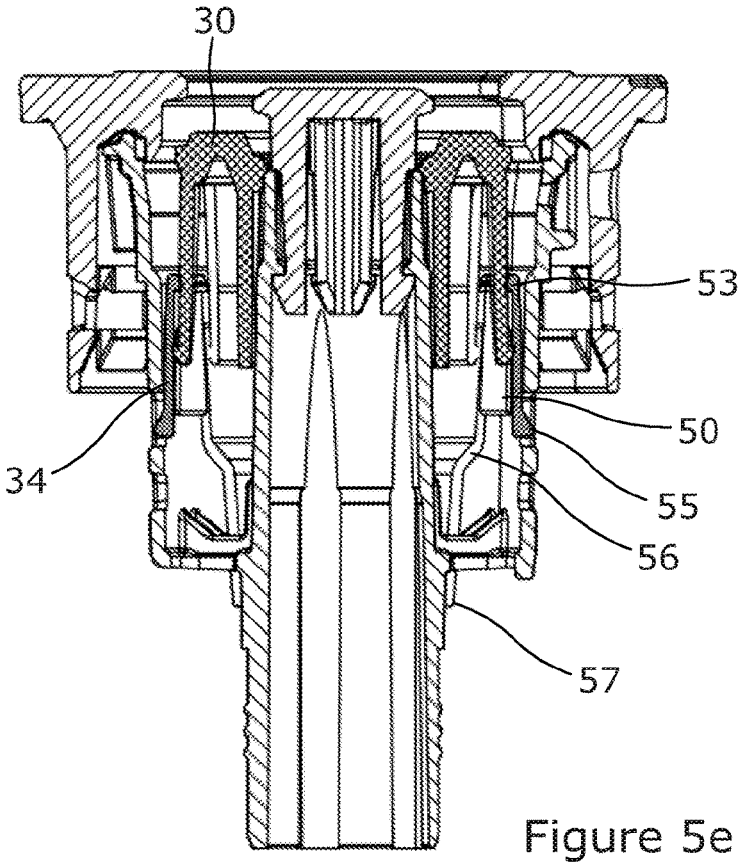
Figure 6E:
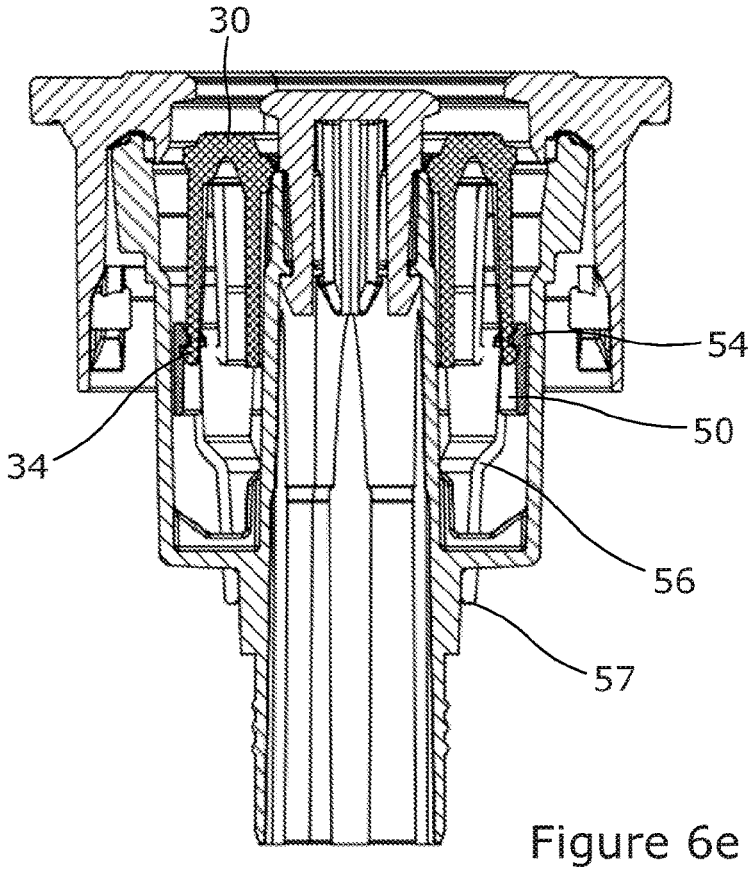

When it is desired to dispense beverage from the keg 90, the closure 1 may be connected to a standard Type-A dispense head including an annular plunger that presses down on the valve element 30 to move the valve element from its closed position downwardly (and inwardly with respect to the keg 90) into an open position in which fluid communication is established with each of the outer and inner flow paths through the closure 1, as illustrated in FIGS. 5*d* and 6*d*. Beverage can then be dispensed from the keg 90 through the closure 1 via the inner flow path as pressurised gas is introduced into the keg 90 via the outer flow path.

When the valve element 30 is moved downwardly into its open position for dispensing beverage, as illustrated in FIGS. 5*d* and 6*d*, the catch formations 34 provided on the arms 33 of the valve element 30 become unhooked from the upper latch elements 53 and move past the lower latch elements 54 provided in the main body portion 51 of the locking element 50 to a position axially below the lower latch elements 54. The catch formations 34 that are aligned with the lower latch elements 54 are deflected radially inwardly as their ramped lower surfaces pass over the ramped upper surfaces of the lower latch elements 54. Engagement of the clip formations 55 in the upper apertures provided in the outer housing wall 21 prevent downward movement of the locking element 50 as the valve element 30 is depressed for dispensing.

When the closure 1 is decoupled from the dispense head, for example after beverage has been dispensed from the keg 90, the valve element 30 is released by the plunger of the dispense head. However, upward movement of the valve element 30 back towards its closed position is limited in extent by the locking element 50 which acts to prevent the valve element 30 from returning to its closed position and sealing the closure 1.

In particular, the hooked upper surfaces of the catch formations 34 that are aligned with the lower latch elements 54 engage the hooked undersides of the lower latch elements 54 to provide a second coupling between the valve element 30 and the locking element 50, which second coupling prevents upward movement of the valve element 30 relative to the locking element 50. In addition, the engagement elements or hook formations 57 provided at the ends of the legs 56 of the locking element 50 engage the stop formations 25*a* provided at the base 25 of the valve housing in order to prevent upward movement of the locking element 50 relative to the valve housing. In this way the closure 1 is prevented from being closed after beverage has been dispensed from the keg 90, such that it is not possible for the keg 90 to be filled, pressurised and closed for a second time after the original contents of the keg 90 have been dispensed while the closure 1 remains coupled to the keg 90.

The above-described locking system is simple and rugged, and provides a reliable and cost-effective mechanism for preventing resealing of a closure 1 after the dispensing of beverage. In particular, the arrangement of the engagement elements or hook formations 57 on legs 56 that extend outwardly from a body 51 of the locking element 50 and protrude to the exterior of the valve housing provides a space efficient mechanism for preventing upward movement of the locking element 50 after the valve element 30 has been coupled to the locking element 50 at the second coupling. The above-described locking system also advantageously allows the height to which the closure 1 extends above the top of the neck 92 of the keg 90 to be minimised.

The position to which the valve element 30 is depressed when the closure is coupled to a dispense head is typically lower than the position to which the valve element 30 is depressed when the closure is coupled to a filling head due to different standard stroke lengths for filling heads and dispense heads. The positions of the upper 53 and lower 54 latch elements relative to the main body of the locking element 50 may be set taking into account the different stroke lengths typically encountered for filling and dispensing, provided that the catch formations 34 of the valve element 30 are capable of engaging the upper latch elements 53 during a fill stroke when the locking element 50 is in its lower position, and capable of engaging the lower latch elements 54 during a dispense stroke when the locking element 50 is in its raised position.

Many modifications may be made to the above examples without departing from the scope of the present invention as defined in the accompanying claims.

For example, in the above-described embodiment, the closure 1 is configured to be snap fitted to the neck of a keg including an annular ring around the neck. However, other attachment mechanisms are also possible. For example, the closure could be configured to be screw fitted to the neck of a keg including a neck portion with external threading, in which case the annular wall of the attachment part could be provided with internal threading.

In addition, the above-described embodiment relates to a Type-A closure for use in combination with standard Type-A filling heads and dispense heads. However, in other embodiments the closure could equally be configured for use with other types of filling and dispensing apparatus. For example, a closure employing one or more of the above-described housing construction (with an integrated outer housing wall and inner duct), venting system and/or locking system could equally include a head portion and valve arrangement configured to cooperate with Type-G, Type-D or Type-S filling heads and dispense heads.

In the above-described embodiment the valve housing of the closure is provided by an outer housing wall 21 that defines a main body of the housing and a head portion 11 that defines a top portion of the housing, the outer housing wall 21 and the head portion 11 being formed separately to each other and configured for mutual attachment. However, in other embodiments at least a portion of the wall forming the main body of the valve housing could equally be integrated together with the head portion. For example, the closure could comprise an attachment part including a head portion for attachment to a filling head or dispense head, and first and second concentric annular walls extending downwardly from the head portion, with the outer one of the annular walls being configured for connection to the neck of a keg, and the inner one of the annular walls being configured to be received within the neck of the keg and to provide a housing for the valve arrangement.

In the above-described embodiment, the outer housing wall (forming the main body of the valve housing) and the inner duct (providing an inner flow path through the closure and an attachment point for an elongate tube or spear) are integrated together with each other as part of a single component. However, in other embodiments the outer housing wall and the inner duct could equally be formed as separate components. In this case the outer housing wall and the inner duct could be attached to each other by a separate intermediate connector component, which may provide a base of the valve housing and an engagement surface for the lower end of the spring.

In the above-described embodiment the vent aperture 27 of the venting system is provided through the outer housing wall 21, and the barrier 29 is attached to the outer surface of the outer housing wall 21. However, in other embodiments the barrier 29 could equally be attached to the inner surface of the outer housing wall 21. In other embodiments the venting system could alternatively be provided in the attachment part 10 by which the closure is attached to the neck of a keg, (instead of in an outer housing wall 21 formed separately to the attachment part 10), with the vent aperture 27 extending through a portion of the attachment part 10 to the exterior of the closure. In other embodiments the venting system may be omitted from the closure.

In the above-described embodiment the engagement elements or hook formations 57 that are configured to prevent further upward movement of the locking element 50 after the locking element has moved into its raised position each project inwardly with respect to the closure 1 and are configured to engage stop formations 25*a* provided on the underside of an integrated connecting portion that connects an outer housing wall 21 to an inner duct 24. However, in other embodiments the engagement elements or hook formations 57 could equally project radially outwardly from the legs 56 of the locking element 50 and be configured to engage the base of the outer housing wall 21. In still further embodiments the legs 56 of the locking element 50 could be configured to extend to the exterior of the valve housing through the outer housing wall 21 instead of through the base 25 of the housing. In other embodiments the locking system may be omitted from the closure.

Other modifications and variations will also be apparent to the skilled person.

The invention claimed is:

1. A closure for a beverage keg, the closure comprising:

a valve housing;

a valve element that is movable with respect to the valve housing inwardly into an open state and outwardly into a closed state; and a locking system comprising a locking element that is movable with respect to the valve housing and is capable of holding the valve element in the open state;

wherein the locking element comprises a body portion located inside the valve housing and at least one leg that extends outwardly from the body portion to the exterior of the valve housing, wherein the leg comprises an engagement element that is configured to engage a stop formation fixed with respect to the valve housing in order to limit the maximum extent of movement of the locking element in an upward direction relative to the valve housing after beverage has been dispensed from the keg.

2. A closure according to claim 1, wherein the at least one leg comprises a plurality of legs.

3. A closure according to claim 1, wherein the valve housing comprises a base including an aperture, wherein the at least one leg extends to the exterior of the valve housing through the aperture provided in the base.

4. A closure according to claim 1, wherein the stop formation is external to the valve housing.

5. A closure according to claim 1, wherein the stop formation is provided on the valve housing.

6. A closure according to claim 1, wherein the stop formation is provided at a base of the valve housing.

7. A closure according to claim 1, wherein the body portion of the locking element is annular.

8. A closure according to claim 1, wherein the at least one leg extends outwardly from the body portion of the locking element in a downward direction.

9. A closure according to claim 1, wherein the at least one leg is elongate.

10. A closure according to claim 1, wherein the engagement element is located at a distal tip of the at least one leg furthest from the body portion of the locking element.

11. A closure according to claim 1, wherein the engagement element comprises a hook formation with a hooked upper surface.

12. A closure according to claim 1, wherein the engagement element protrudes from the at least one leg in a radially inward direction with respect to the closure.

13. A closure according to claim 1, wherein the locking element is movable relative to the valve housing between a first position in which the valve element is engageable with the locking element at a first coupling when the valve element is moved into an open state, and a second position in which the valve element is engageable with the locking element at a second coupling when the valve element is moved into an open state.

14. A closure according to claim 13, wherein the locking system comprises a retaining arrangement for releasably retaining the locking element in the first position and/or for preventing downward movement of the locking element from the second position back into the first position after the locking element has been moved into the second position.

15. A closure according to claim 1, further comprising a head portion configured for attachment to a filling head or dispense head.

16. A beverage keg supplied with or fitted with a closure according to claim 1.

* * * * *